US005899515A

United States Patent [19]

Burns

[11] Patent Number: 5,899,515

[45] Date of Patent: May 4, 1999

[54] FLIGHT CARRIER

[76] Inventor: Curtis A. Burns, 4100 N. Marine Dr., #8L, Chicago, Ill. 60613

[21] Appl. No.: 08/978,749

[22] Filed: Nov. 26, 1997

[51] Int. Cl.[6] ..... B65D 71/00; A45F 5/10

[52] U.S. Cl. ..... 294/159; 294/87.28

[58] Field of Search ..... 294/87.2, 87.28, 294/92, 143, 144, 145, 146, 159, 172; 206/152, 153, 158, 162, 199, 201, 202; 248/311.2–312.1

[56] References Cited

U.S. PATENT DOCUMENTS

| | | | |
|---|---|---|---|
| 2,264,903 | 12/1941 | Kruea | 294/87.28 |
| 2,508,945 | 5/1950 | Heuer | 294/87.28 |
| 2,616,751 | 11/1952 | Goldenberg | 294/87.28 |
| 2,654,628 | 10/1953 | Klante | 294/159 |
| 3,003,805 | 10/1961 | Glazer | 294/87.2 |
| 3,036,853 | 5/1962 | Glazer | 294/87.2 |
| 4,049,126 | 9/1977 | Halverson | 294/159 |
| 4,623,185 | 11/1986 | Thomas | 294/159 |
| 5,361,956 | 11/1994 | Recanati | 294/159 |

FOREIGN PATENT DOCUMENTS

| | | | |
|---|---|---|---|
| 159912 | 4/1933 | Switzerland | 248/312 |
| 2163344 | 2/1986 | United Kingdom | 294/87.2 |

*Primary Examiner*—Dean Kramer
*Attorney, Agent, or Firm*—Ray K. Shahani, Esq.

[57] ABSTRACT

A flight carrier for simultaneously transporting one or more wine glasses or other type of glasses, tumblers or other fluid containers having a generally upwardly and outwardly expanding shape. The flight carrier comprises an essentially flat, planar lifting portion of operatively rigid material, the lifting portion having a front edge having a plurality of sequentially spaced openings therein, the openings extending into the flat planar portion, and a handle portion coupled to and acting on the lifting portion. Another embodiment of the flight carrier comprises a plurality of semicircular rings sequentially spaced apart by and rigidly coupled to a plurality of short connector portions.

5 Claims, 5 Drawing Sheets

FLIGHT CARRIER

FIELD OF THE INVENTION

The present invention relates to methods and apparatus for lifting, carrying and serving flights of beverage glasses, i.e., more than one, and generally about four wine or other type of glasses, each containing a small amount of wine or other beverage.

In particular, the present invention is directed to a carrier for a flight of glasses in which a glass lifting portion is capable of fitting simultaneously around the stem of the plurality of glasses between the foot and the bowl with a handle portion. The apparatus can lift the entire flight of glasses safely and conveniently, such as for service between a bar and tables.

BACKGROUND OF THE INVENTION

The tremendous explosion in the popularity of drinking wine in the 1980s and 1990s through the world has brought about the establishment of dozens if not hundreds of small to medium sized restaurants and cafes with extensive and creative wine and other beverage lists. Sales of wines, beers, champagnes, brandies, appertifs and other beverages comprise a very large percentage of overall gross revenue for such establishments. In all metropolitan areas it is not unusual to find an extensive wine list containing between 50 and 100 different such beverages in stock and for sale.

Sales of wine, beer or other beverages at restaurants typically include sales of full bottles, glasses or flights. Full service wine merchants offer flights of wine or other drinks as a way of educating their customers as to the differences in different types of wines as well as to enhance revenues of such. Customers can select individual glasses of wine, or they can select a flight of wines. A flight of wines consists of about four glasses containing about 1.5 ounces of wine each. A flight can consist of 2 or 3 or 5 or 6 or more wines as well. Often flights of wine are given names descriptive of the wines they contain, such as "bold Chardonnay flight" or "Spanish flight". By ordering a flight of wines, with the names of the various wines which make up the flight listed on a menu or side card, customers, wine or other tasters of beverages can sample a larger number of wines or other beverages more conveniently.

FIG. 1 is an isometric view of a flight board 100 of the prior art. In the past, presentation of wine or beer in flights was facilitated using a standard tray or board. Unfortunately, glasses 50 slide on flat trays and can knock together having unfortunate results. Such boards 100 with small grooves or indentations 102 inset into the top surface have been used to facilitate service of a number of glasses 50 of liquid, generally wine glasses which may tend to be somewhat top heavy anyway, but are less than adequate. Such wine or drink boards 100 would generally be left at the table, an aesthetically undesirable feature, and lifting and setting down the loaded boards is continually fraught with tippage hazzard. And the need to find sufficient table space.

Not only does service of a flight of drinks typically involve a great risk of tippage and/or spillage, but other drawbacks of such presentation are inherent. Since rather than serve a singe 6 ounce glass a flight might consist of four—1.5 once servings. Therefore, increased service time is inherent with typical flight service. As importantly, server and/or customer confusion is also a problem with flight service. Unless the glasses are kept in a certain spatial orientation, and such can be remembered during the process of pour from bottle to placement on the bar to collection by a server to delivery to a table, the identity of the wine or other drink may be forgotten or confused.

Therefore, it would be advantageous to provide a method and apparatus for service of a flight of beverages, such as about two to about four or more wine glasses, to avoid the problems associated with the prior art,

SUMMARY OF THE INVENTION

In summary, the present invention is a carrier for a flight of glasses in which a glass lifting portion is capable of fitting simultaneously around the stem of the plurality of glasses between the foot and the bowl with a handle portion. The apparatus can lift the entire flight of glasses safely and conveniently, such as for service between a bar and tables.

In one embodiment, the lifting portion consists of a number of grasping fingers extending from a horizontally extending, optionally curved structure. The grasping fingers can be spherically or other shaped rings with an discontinuity which define an aperture or opening withing the ring or other shaped structure. Other shapes include ovals, other curves, triangular, rhomboidal or trapezoidal or other shaped. The rings are linked together with interconnecting members which separate the glasses from each other so as to avoid clinking or rattling, and potential scratching and cracking. The apparatus includes a handle which, when used to bring the apparatus in place, will cause the lifting portion to act contemporaneously on the four or more or less glasses in the particular flight being transported.

In another embodiment, a flat member with a series of hemispherical or other operatively shaped apertures with discontinuities at a common facing edge of the flat member, also optionally with a selected curvature, is also designed to be fit between the bowl and foot of a number of wine glasses or other types of glasses, such that lifting a handle portion will lift the glasses upwards off of a surface in an upright and stable position.

Thus, it is an advantageous of the present invention to provide a carrier for flights of glasses, i.e., a carrier for simultaneously carrying a plurality of glasses safely and conveniently, which overcomes the disadvantages of the prior art. In particular, it is an advantage of the present invention to provide an apparatus and method for lifting a number of beverage glasses simultaneously by providing a lifting portion having a number of openings for lower support of the bowls or bodies of glasses.

Additional advantages of the present invention include reduced effort and time and increased efficiency in transporting individual flights and also two or more flights together as compared to methods of serving flights of beverages or drinks in the past. Advantages include enhanced drink identification and tracking capability since a front end and a back end of the flight carriers can also be labeled or otherwise identified as such.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
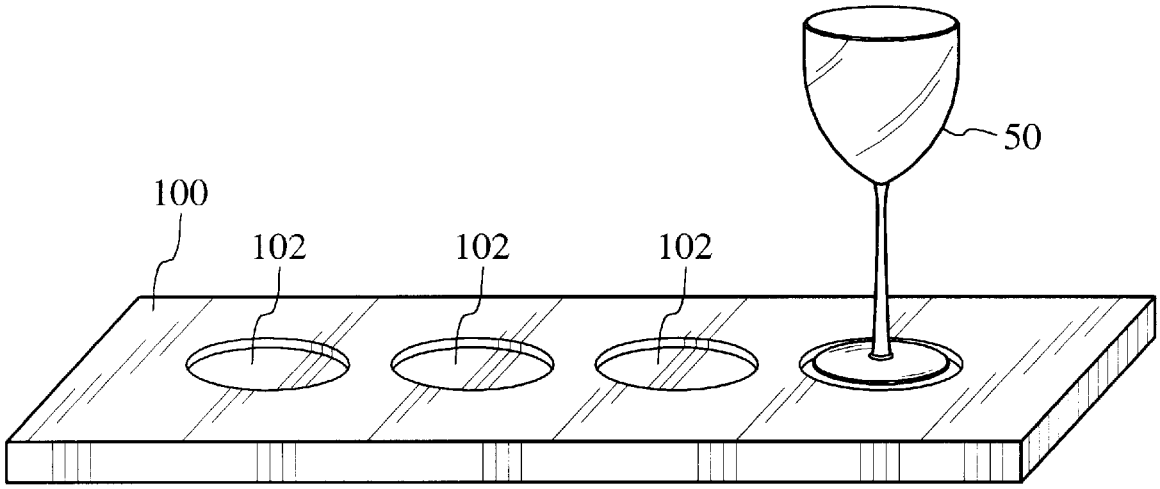
FIG. 1 (PRIOR ART)
FIG. 1 is an isometric view of a flight board 100 of the prior art.

It will be understood that while numerous preferred embodiments of the present invention are presented herein, many of the individual elements and functional aspects of the embodiments are similar. Therefore, it will be understood that structural elements of the numerous apparatus disclosed herein having similar or identical function will have like reference numerals associated therewith.

Figure 2:
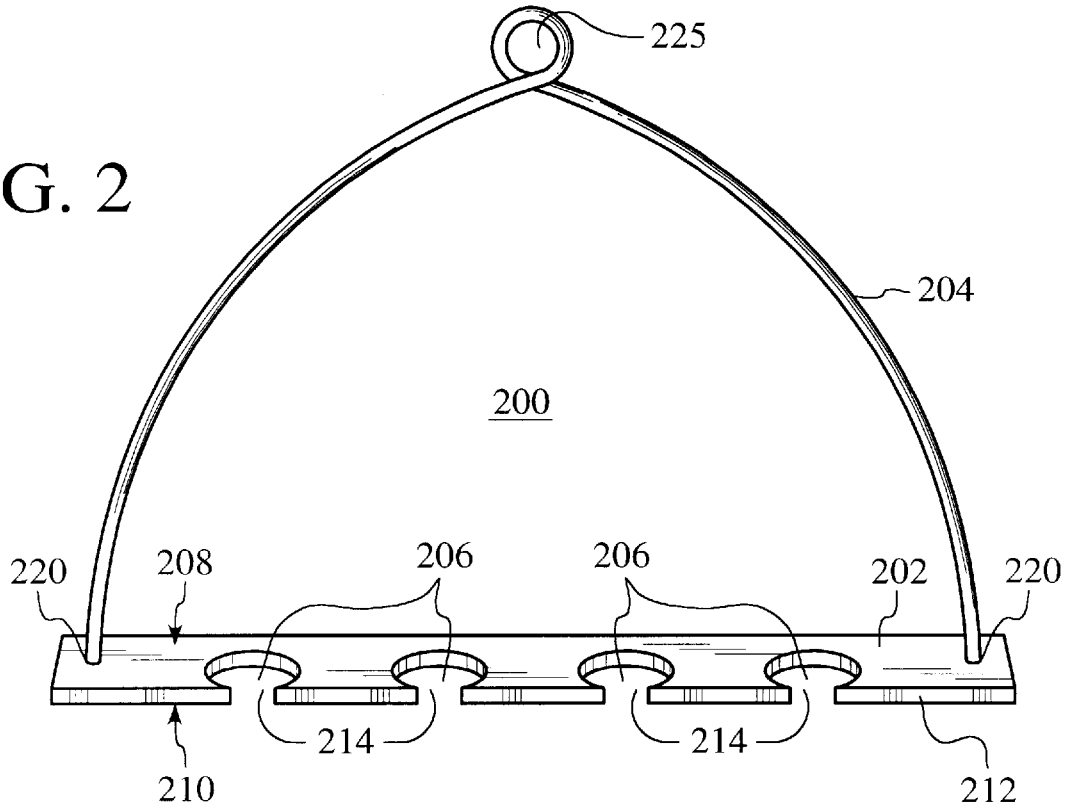
FIG. 2 is an isometric view of a preferred embodiment of a flight carrier 200 of the present invention.

FIG. 2 is an isometric view of a preferred embodiment of a flight carrier 200 of the present invention. The flight carrier 200 consists of a lifting portion 202 and a handle portion 204. The lifting portion 202 comprises a flat board or other flat structural member with openings 206 extending through the lifting portion 202 between the upper surface 208 and a lower surface 210 (not shown). The term flat refers essentially to the cross section of the apparatus, which could, in fact, have a variety of shapes, other than thin and narrow as would correspond to the flat, planar shape of the member 202. The intersection of the openings 206 and a front or facing edge 212 define a series of discontinuities 214 in the front facing edge 212 of the flat structural lifting portion 202. It is through these discontinuities that the stems or bodies of glasses can fit into and/or through the apertures 206 and be supported by the lifting portion 202 thereby.

It will be understood that both any or all of the lifting portion 202 as well as any or all of the handle portion 204 can be formed of any operative material, including stainless steel, aluminum or other metal, wood, plastic or other polymeric material, any suitable composite or resin, or other synthetic or natural material. The material chosen will have an appropriate stiffness, degree of rigidity or otherwise generally high durometer to prevent deformation of the apparatus during use but so as to provide a comfortable, ergonomic, optionally padded apparatus which cushions the hands of the user as well as the glass lifting portion 202 itself. Such padding could comprise a layer of latex or other rubber, etc. Additionally, other materials may be used to coat the surface of the apparatus 200 or the surface of the apparatus 200 could be textured. This would provide the desired smoothness, gripping quality or other desired surface characteristic. As mentioned above, the shape of board 202 can be varied for enhanced ornamental or functional purpose.

Handle portion 204 couples to flat lifting portion 202 in any suitable, operative, aesthetically appropriate manner, including screws and nut, welding, gluing or integral construction such as by molding, extrusion, etc. at connection termini 220. Additionally, a hanging, carrying or other function hook 225 at a point such as midway between termini 220 of handle portion 204 will facilitate storage and handling, transportation, use, cleaning, etc. of the apparatus 200. Such hook element 225 can have any operative size and/or shape, material of construction, integral construction, etc. and will be known to those skilled in the art.

It will be understood by the foregoing and following that specific shapes, dimensions and carrying capacity in terms of numbers of drinks which can be carried at one time by the apparatus can be changed and modified without deviating from the scope of the present invention. The flight carrier 200 of the present invention can be used for carrying anywhere between 1 and 10 glasses at one time. Glasses can be doubled up if the apertures 206 are elongated or otherwise enlarged. Finally but not limiting in any way, the lifting portions 202 and the handle portions 204 can be given a curvature, angle, or other geometric variation as well. It will be noted that in a configuration of glass carrying openings 206 in which the glasses were lifted up and set onto a table or bar in a semicircular or other curved, geometric relationship to each other, the overall length or other horizontal dimension will possible be shorter or smaller than would be required for lifting a series of wine or other glasses sitting in a straight row.

Figure 3:
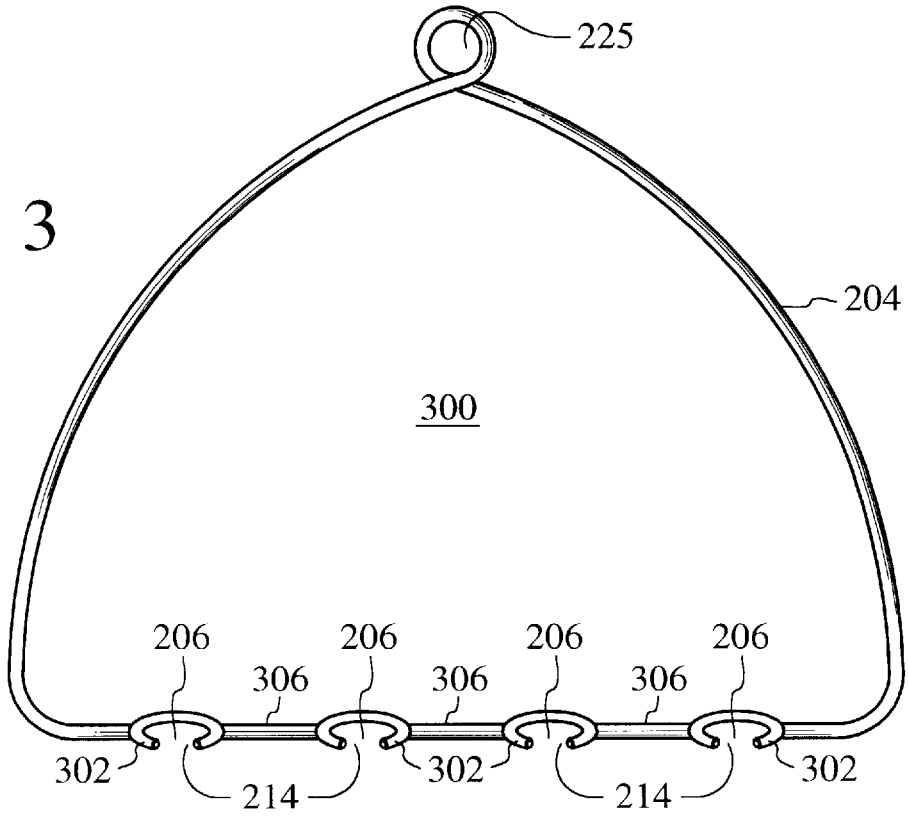
FIG. 3 is an isometric view of another preferred embodiment of a flight carrier 300 of the present invention.

FIG. 3 is an isometric view of another preferred embodiment of a flight carrier 300 of the present invention. In this embodiment, apertures 206 have similar if not identical function as for those described with respect to FIG. 2. However, such apertures 206 in flight carrier 300 are formed out of semi-circular rings 302. These rings 302 each have a gap or structural discontinuity 214. When coupled together in a straight line or other geometric relationship, such as by interconnecting members 306, in any operative relative orientation to each other each with its respective discontinuity 214 facing a common direction. Thus, when positioned by a server or other user of the carrier apparatus 300 such that the series of rings 302 each encircle the stem or body portions of glasses sitting on a surface (not shown), the carrier 300 can be lifted so as to simultaneously lift and support the glasses.

It will be understood that the rings 302 can be circular (as shown), or can also have a triangulated, square, etc. shape. Furthermore, such rings 302 can be formed of any suitable, operative material, either rigid or flexible to a certain extent. A certain amount of rigidity of the rings 302 themselves will probably be necessary, however the connecting members 306 can have essentially any amount of rigidity or flexibility as may be desired. Additionally, as above, the rings 302 can be configured in a relatively linear, straight pattern so as to engage with a series of glasses similarly spaced, or the rings 302 can be connected in a hemispherical or semispherical, or other curved or angled shape.

Figure 4:
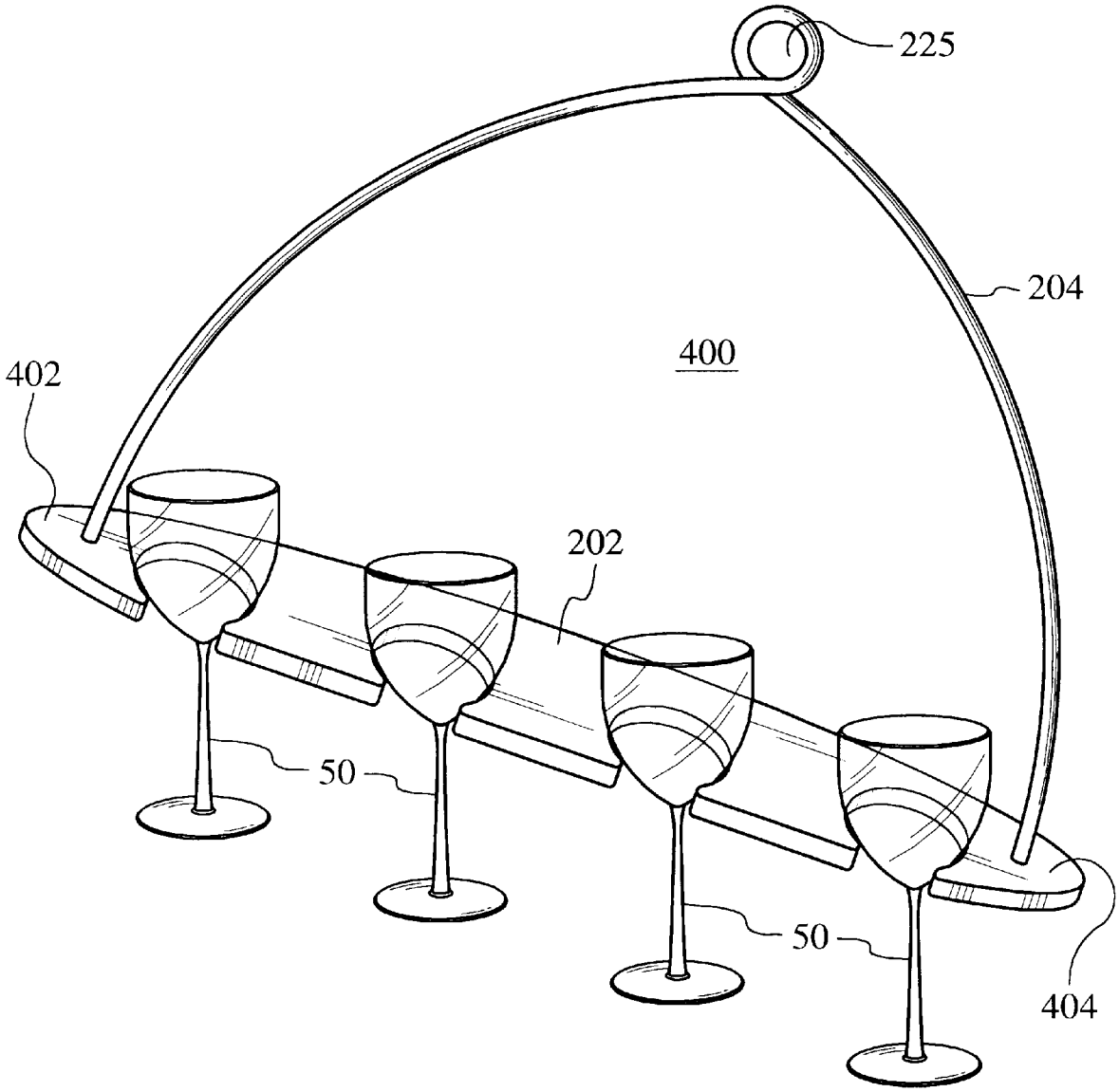
FIG. 4 is a representative method of use of another preferred embodiment of a flight carrier 400 of the present invention.

FIG. 4 is a representative method of use of another preferred embodiment of a flight carrier 400 of the present invention. This drawing shows four wine glasses 50 suspended from carrying portion 202. It will be noted that even if the apparatus 400 is lifted so that one end 402 is higher than another end 404, the glasses themselves 50 may be prevented from tipping or spilling due to the fact that they will each stand upright, possibly due to the weight of the stems and feet of the glasses 50. Therefore, it will be obvious that the wine flights 200, 300, and 400 of the present invention will be much easier to use and forgiving to bartenders and servers compared to the flight boards 100 of the prior art in which a level surface had to be maintained to avoid the familiar problems of tipping and spilling.

Figure 5A:
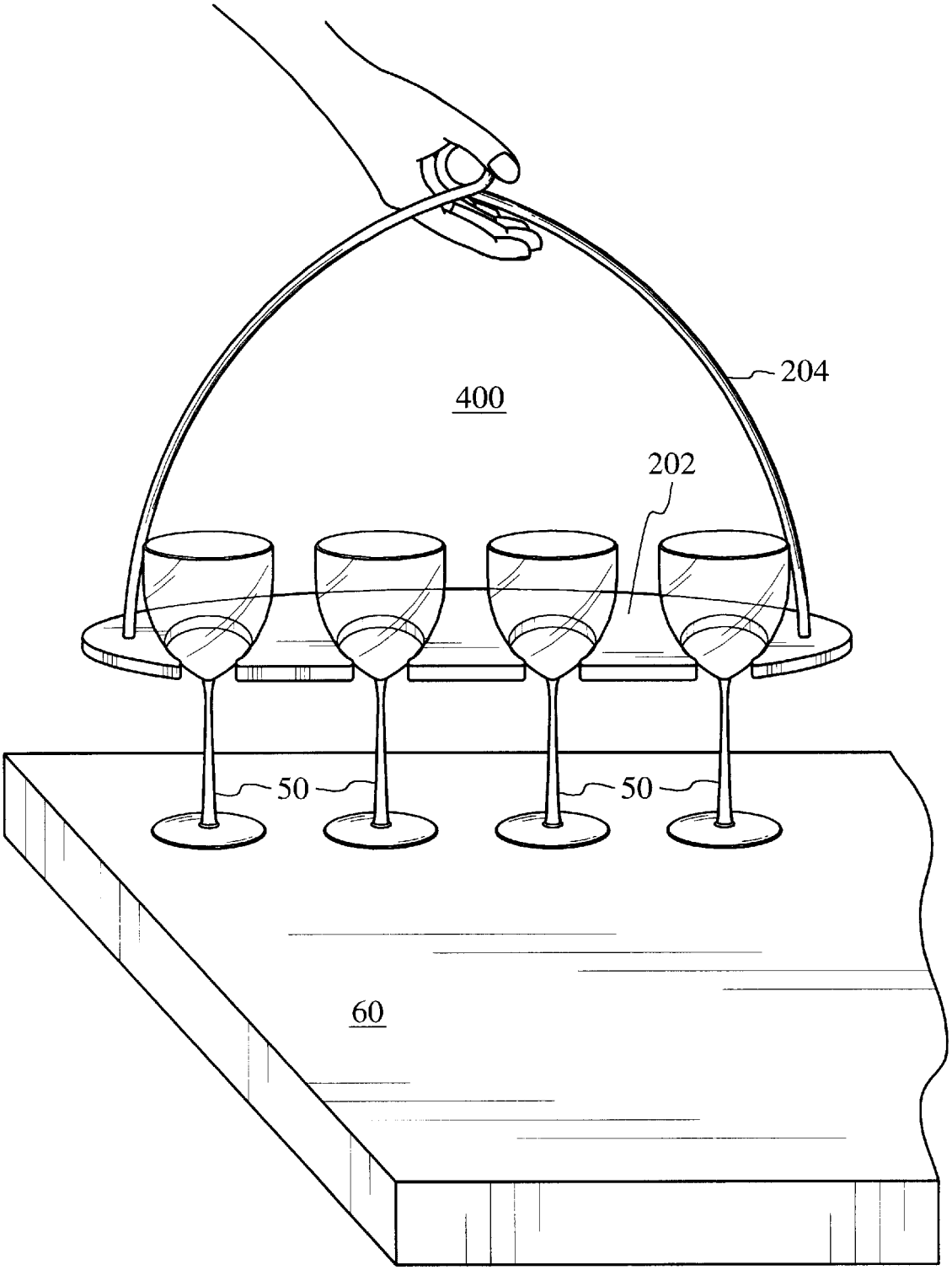
FIGS. 5A and 5B are representations of a method of use of another preferred embodiment of a flight carrier 400 of the present invention.
Figure 5B:
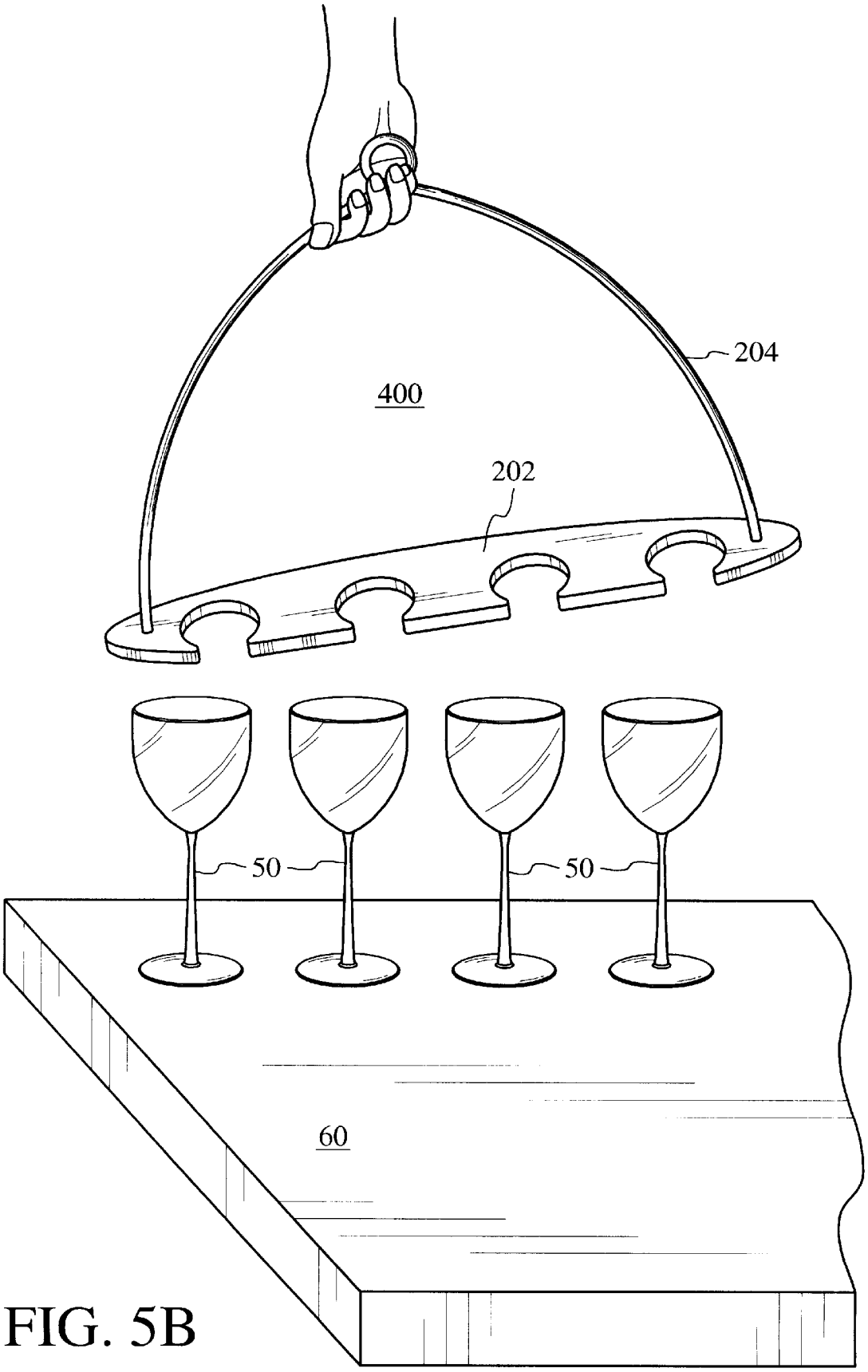

FIGS. 5A and 5B are representations of a method of use of another preferred embodiment of a flight carrier 400 of the present invention. As shown, the flight carrier 400 of the present invention can be utilized to either lift a set of wine glasses 50 off of a surface 60, to place a set of wine glasses onto a surface 60 or to carry a set of wine glasses 50 between one or more surfaces 60 by lifting the apparatus 400 utilizing any part of the handle portion 204 essentially in an upwards direction, the carrying board or lifting portion 202 will engage with the glasses 50 and the entire assembly will be transportable as one. Thereafter, when setting the glasses 50 onto surface 60, once the feet of the glasses 50 come in contact with the surface 60, the lifting board portion 202 will, upon further slight downward motion, disengage itself from the individual glasses 50. Upon relocation of the apparatus 400, the glasses 50 will be left standing on the surface 60 being untouched by the apparatus by the stems of the glasses 50 passing through the openings 206 of the lifting portion 202. A similar situation would occur with the embodiment 300 shown in FIG. 3, i.e. the stem of the glasses 50 or other portion would pass through the gap or discontinuities 214 of the carrying rings 302, untouched thereby.

Unless defined otherwise, all technical and scientific terms used herein have the same meaning as commonly understood by one of ordinary skill in the art to which this invention belongs. Although any methods and materials similar or equivalent to those described can be used in the practice or testing of the present invention, the preferred methods and materials are now described. All publications and patent documents referenced in this application are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

We claim:

1. A flight carrier for transporting a plurality of wine glasses or other stemmed glassware having generally upwardly and outwardly expanding bowl shape portions which taper at their bases into relatively narrower, vertical stem portions and lower base portions, the flight carrier comprising:

a rigid horizontal portion comprising a plurality of sequentially spaced, essentially coplanar lifting portions defining a plurality of openings, the plurality of openings disposed along a curvature; and a handle portion, the handle portion coupled to and acting on the horizontal portion such that the plurality of wine glasses or stemmed glassware resting on the lifting portions of the horizontal portion hang essentially directly below the handle.

2. The flight carrier of claim 1 in which the horizontal portion has at least one first end and at least one second end and the handle portion is coupled to the at least one first end and to the at least one second end of the horizontal portion.

3. The flight carrier of claim 1 in which each of the plurality of lifting portions comprise a semicircular ring, the plurality of rings sequentially spaced apart and coupled together.

4. The flight carrier of claim 3 in which the plurality of semicircular rings are rigidly coupled together.

5. The flight carrier of claim 1 in which the horizontal portion has a unitary construction.

* * * * *